US006575316B2

(12) United States Patent
Lin

(10) Patent No.: US 6,575,316 B2
(45) Date of Patent: Jun. 10, 2003

(54) BATHROOM COLUMN HANGING HOLDER ASSEMBLY

(75) Inventor: Gary Lin, Taipei (TW)

(73) Assignee: Colin Ross Taiwan, Inc., Taipei (TW)

( * ) Notice: Subject to any disclaimer, the term of this patent is extended or adjusted under 35 U.S.C. 154(b) by 0 days.

(21) Appl. No.: 09/984,081

(22) Filed: Oct. 26, 2001

(65) Prior Publication Data

US 2003/0080081 A1 May 1, 2003

(51) Int. Cl.[7] ..... A47F 5/00

(52) U.S. Cl. ..... 211/205; 211/107; 211/207; 248/230.2

(58) Field of Search ..... 211/205, 196, 211/107, 207, 187, 90.02; 242/597.8; 248/230.1, 230.2, 245, 246, 158; D6/551, 524, 527; 108/151, 147.12, 147.13

(56) References Cited

U.S. PATENT DOCUMENTS

D69,281 S * 1/1926 Nelson
1,742,164 A * 12/1929 Berke
2,716,533 A * 8/1955 Freeman
3,076,557 A * 2/1963 Husted et al.
3,245,365 A * 4/1966 Doherty
4,678,089 A * 7/1987 Lang ..... 211/205 X
5,148,928 A * 9/1992 Arnold ..... 211/187
D400,747 S * 11/1998 Warshawsky ..... D6/527
D406,960 S * 3/1999 Zaid
6,318,572 B1 * 11/2001 Lai ..... 211/196
D453,888 S * 2/2002 Gottwald ..... D6/551

* cited by examiner

*Primary Examiner*—Robert W Gibson, Jr.
(74) *Attorney, Agent, or Firm*—Troxell Law Office PLLC

(57) ABSTRACT

A bathroom column hanging holder assembly mainly has a plurality of sleeves sleeved on a column with a base seat; the side of the sleeve has a side tube to be fixedly inserted by a hanging holder; a plastic inner tube and an O-shaped ring are installed inside the said sleeve; the structure assembled accordingly is capable of positioning a sleeve through the friction generated among the plastic inner tube, the O-shaped ring and the column by the weight of the hanging holder so as to eliminate the downward sliding of the sleeve and to adjust the height of the sleeve at will for convenient application.

5 Claims, 5 Drawing Sheets

BATHROOM COLUMN HANGING HOLDER ASSEMBLY

BACKGROUND OF THE INVENTION

1) Field of the Invention

The present invention relates to a bathroom column hanging holder assembly, more especially to a bathroom hanging holder assembly comprising a plurality of sleeves sleeved on a column with a base seat; the side of the sleeve has a side tube to be fixedly inserted by a hanging holder; a plastic inner tube and an O-shaped ring are installed inside the said sleeve; the weight of the hanging holder causes the friction to be generated among the plastic inner tube, the O-shaped ring and the column so as to positioning the sleeve, eliminate the downward sliding thereof and to adjust the height thereof at will for convenient application.

2) Description of the Prior Art

Accordingly, in addition to the toiletries for cleansing, a toilet paper rail, a toilet scrubber and a towel rail are also placed individually or installed separately on the wall in a bathroom; usually, the toilet paper rail and the towel rail are nailed fixedly on the wall; however, to dismount they for new locations or replacement later will leave many nail holes on the ceramic tiles on the bathroom wall and that also influences the pleasant appearance.

Furthermore, a common bathroom is not spacious; with too many racks for holding toiletries installed on the wall, it will look messy and also influence the pleasant appearance.

In order to solve the problems of messy situation caused by having too many toiletry holders in the bathroom, a structure is provided for assembling various types of toiletry holders in one unit that has a vertical rod fixedly mounted with different holders by means of screws.

However, since the holders are screwed to the rod body, when trying to adjust the height, one needs to use a hand-tool such as a screw driver to unscrew the holders first, then reassemble them for positioning and that is very inconvenient in use.

SUMMARY OF THE INVENTION

In view of the mentioned shortcomings of the conventional toiletry holders, the inventor of the present invention researched and designed a bathroom column hanging holder assembly having a plurality of sleeves sleeved on a column with a base seat; the side of the sleeve has a side tube to be fixedly inserted by a hanging holder; a plastic inner tube and an O-shaped ring are installed inside the said sleeve; the structure assembled accordingly is capable of positioning a sleeve through the friction generated among the plastic inner tube, the O-shaped ring and the column by the weight of the hanging holder so as to eliminate the downward sliding of the sleeve and to adjust the height of the sleeve at will for convenient application.

Therefore, the primary objective of the present invention is to provide a bathroom column hanging holder assembly having a plurality of sleeves sleeved on a column with a base seat; the side of the sleeve is fixedly inserted by a hanging holder; a plastic inner tube and an O-shaped ring are installed inside the said sleeve; a sleeve is thus positioned through the friction generated among the plastic inner tube, the 0-shaped ring and the column by the weight of the hanging holder so as to eliminate the downward sliding of the sleeve and to adjust the height of the sleeve at will for convenient application.

In order to enable a further understanding of the present invention, the brief description of the drawings below is followed by the detailed description of the preferred embodiment.

DETAILED DESCRIPTION OF THE PREFERRED EMBODIMENTS

Figure 1:
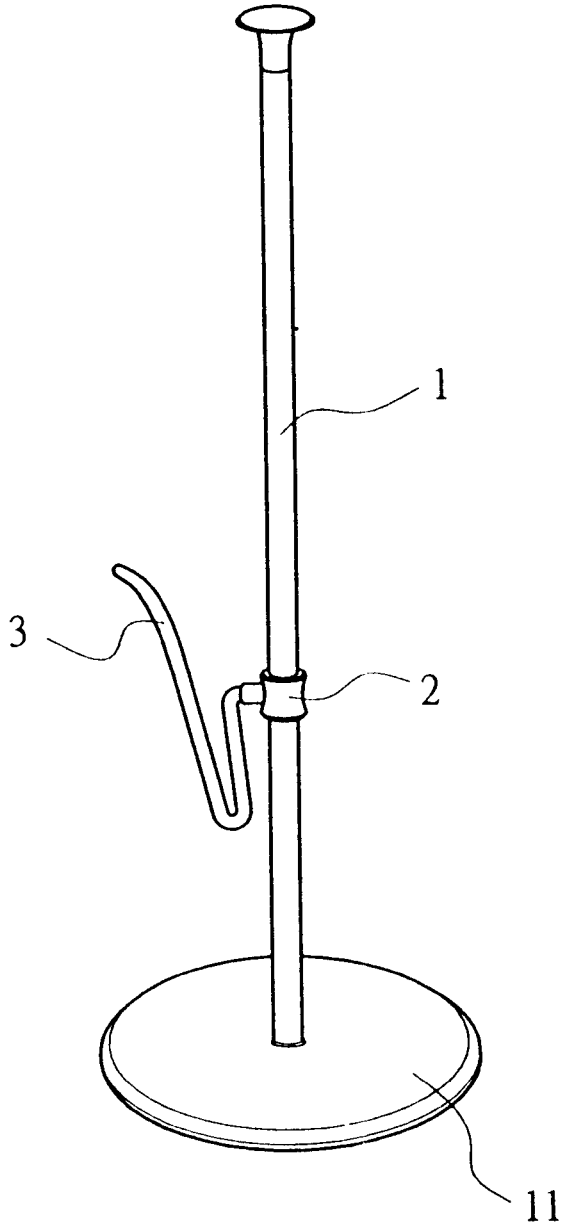
FIG. 1 is a pictorial drawing of the present invention.
Figure 2:
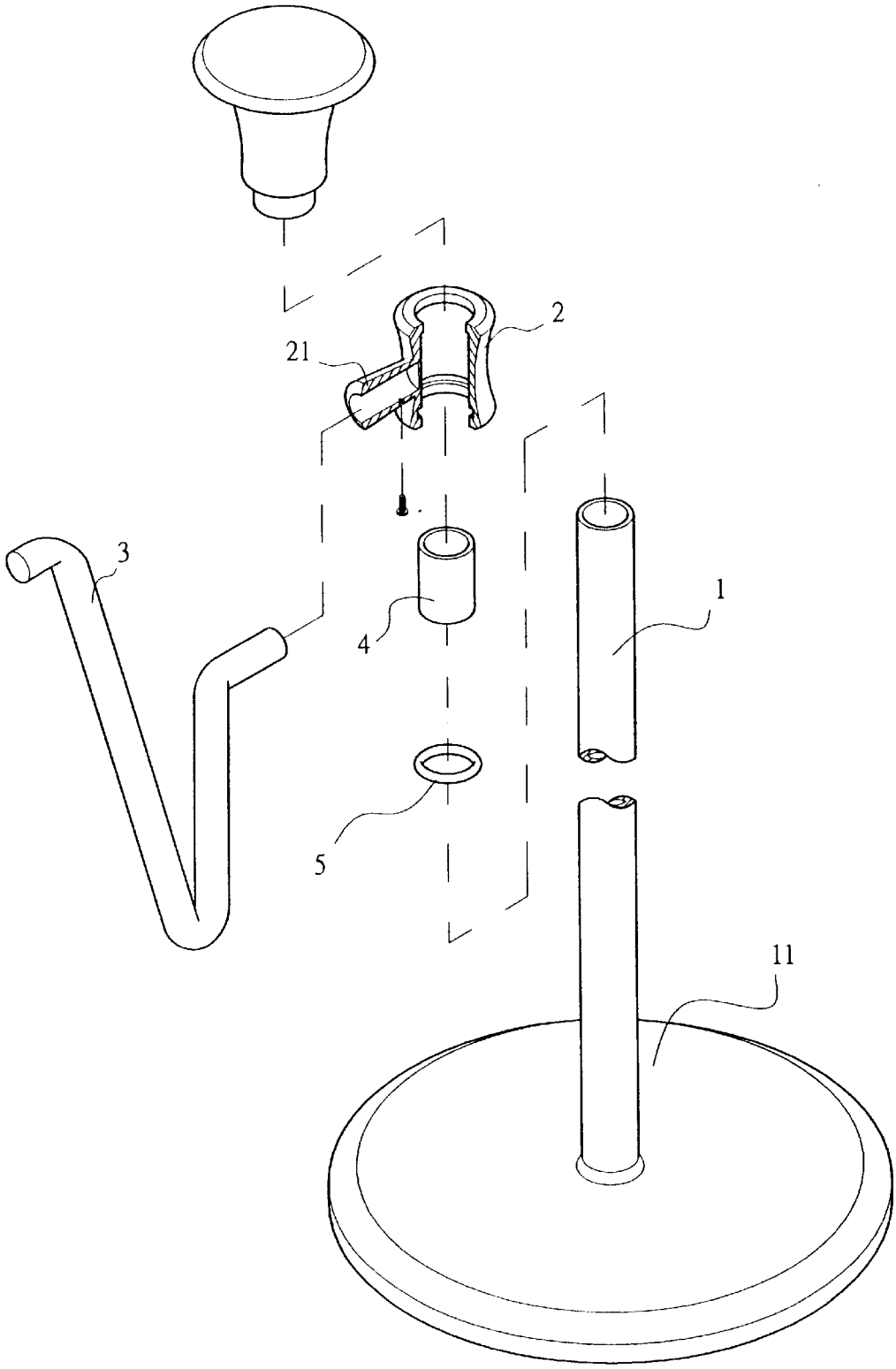
FIG. 2 is a pictorial and exploded drawing of the present invention.
Figure 3:
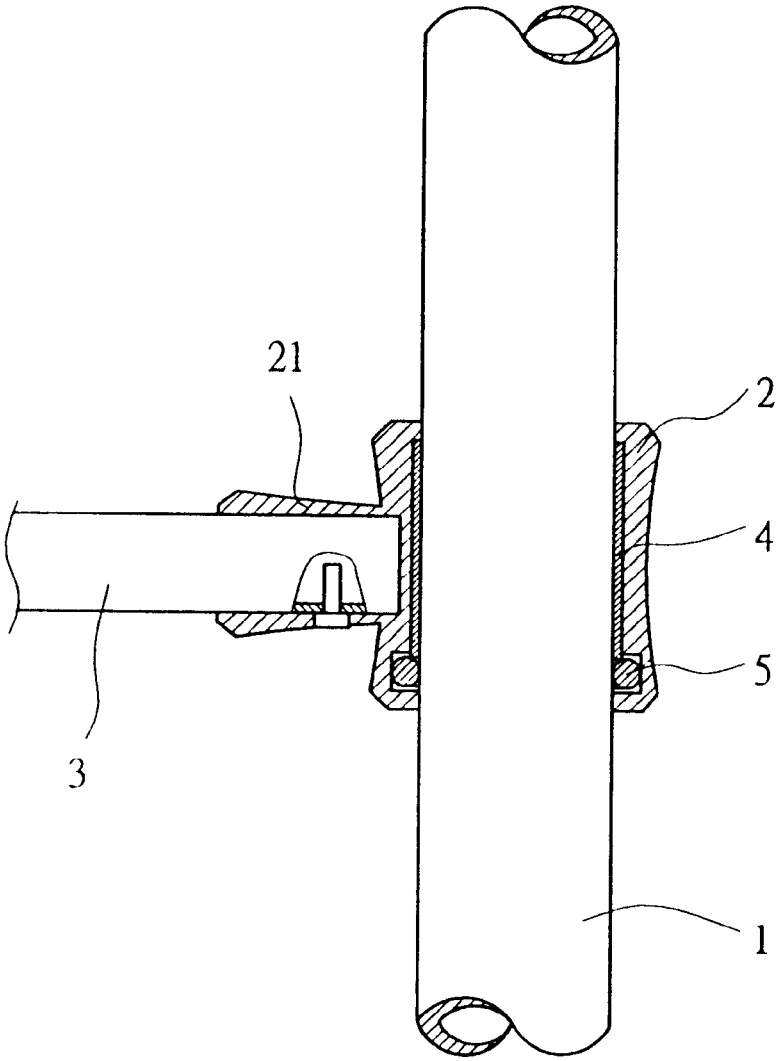
FIG. 3 is a cross-sectional view drawing of the partial assembly of the present invention.

Referring to FIGS. 1 and 2, the present invention mainly comprises a plurality of sleeves (2) sleeved on a column (1) with a base seat (11); the side of the sleeve (2) has a side tube (21) to be fixedly inserted by a hanging holder (3); a plastic inner tube (4) and an O-shaped ring (5) are installed inside the said sleeve (2), as shown in the FIG. 3.

The structure assembled accordingly is capable of eliminating the downward sliding of the sleeve (2) through the friction generated between the O-shaped ring (5) and the column (1) since the plastic inner tube (4) and the O-shaped ring (5) are installed inside the said sleeve (2).

Figure 4:
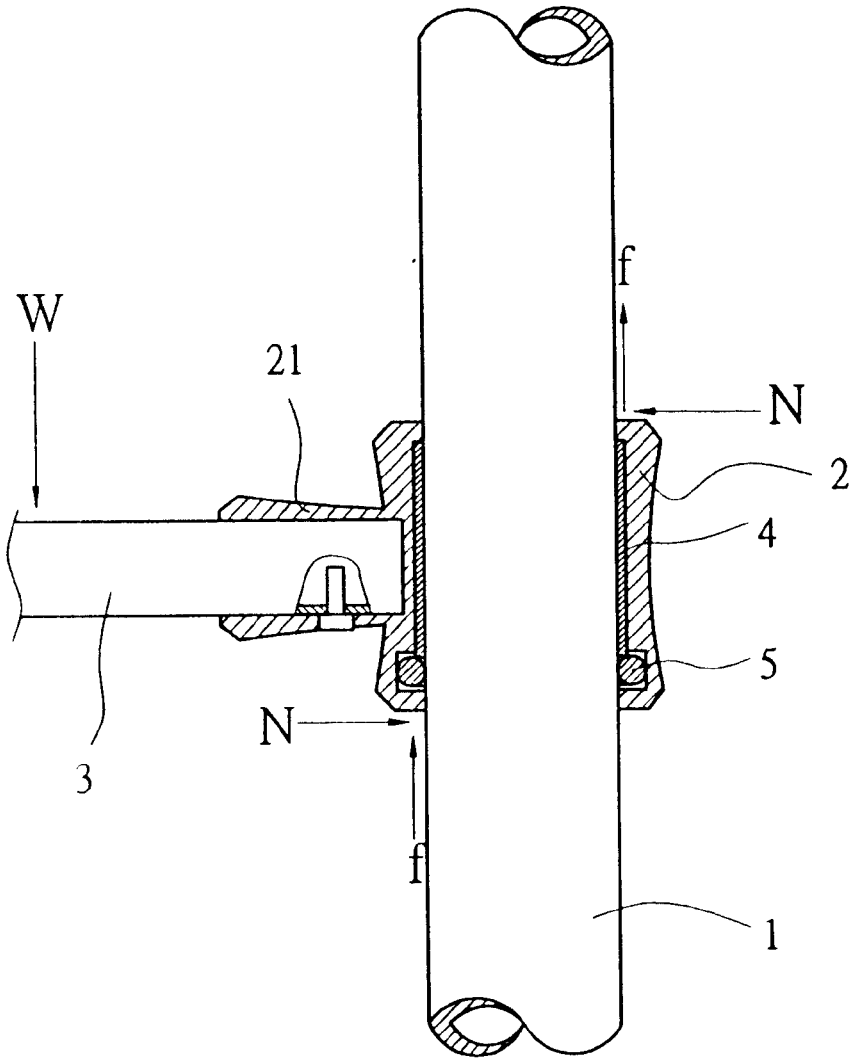
FIG. 4 is a schematic drawing of the mechanics analysis of the present invention.

Furthermore, since the side of the said sleeve (2) is disposed with the side tube (21) fixedly inserted by the hanging holder (3), the total weight (W) of the hanging holder (3) and the toiletries placed thereon causes the outer side of the upper end of the plastic inner tube (4) and the inner side of the O-shaped ring (5) to respectively generate a positive pressure (N) as well as a upward friction (f), as shown in FIG. 4; the sum of the two frictions (f) eliminates the downward sliding of the sleeve (2) and the hanging holder (3) thereon.

When trying to adjust the height of the sleeve (2), it is necessary to hold the hanging holder (3) to relatively offset the total weight (W) of the hanging holder (3) and the toiletries placed thereon to make the said sleeve (2) not to generate the positive pressure (N), thereby no upward friction (f) is produced so that the sleeve (2) can be directly pushed up or down for conveniently adjusting the height of the sleeve (2).

Figure 5:
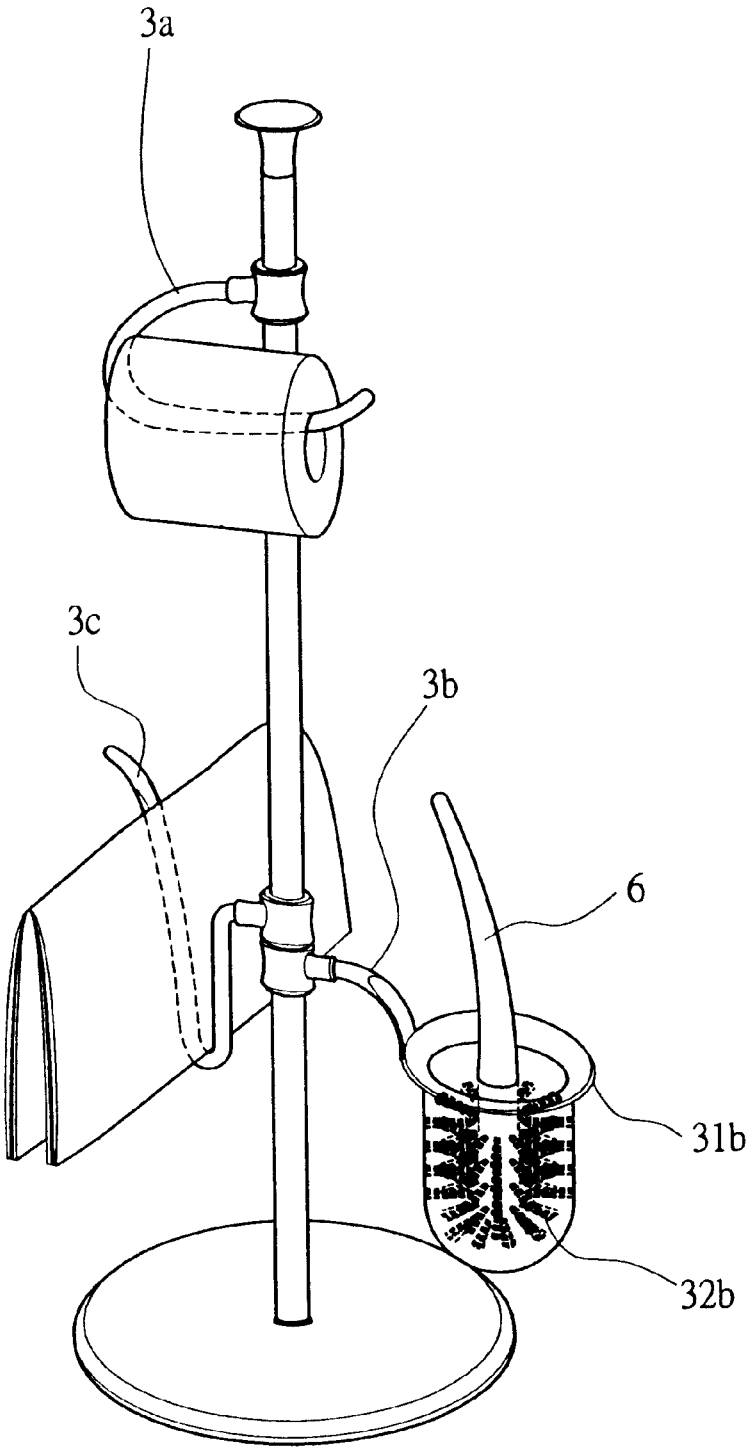
FIG. 5 is an exemplary embodiment of the hanging holder of the present invention.

Referring to FIG. 5, the said hanging holder (3) can be a toilet paper rail **(3*a*) in the form of a bent C-shaped rod, or a rod holder (3*b*) with an insert ring (31*b*) to be inserted by a bearing container (32*b*) for placing a toilet scrubber (6), or a magazine holder (3*c*) in the form of a bent V-shaped rod; those are the various exemplary embodiments of the hanging holder (3)** of the present invention.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A bathroom column hanging holder assembly comprising:

an elongated column with a base seat;

at least one sleeve movably located on the column, the sleeve having a hollow cylindrical configuration with a lowermost end and an inwardly opening annular groove adjacent to the lowermost end;

a plastic inner tube member mounted on an interior of the at least one sleeve so as to contact the column;

an O-shaped ring mounted in the annular groove of the sleeve so as to move with the sleeve relative to the column; and a single hanging holder extending from one side of the sleeve, whereby weight of an object on the hanging holder urges the O-shaped ring and an upper end of the inner tube member into contact with the column so as to prevent movement of the sleeve relative to the column.

2. The bathroom column hanging holder assembly according to claim 1, wherein the hanging holder comprises a toilet paper rail in the form of a C-shaped rod.

3. The bathroom column hanging holder assembly according to claim 1, wherein the hanging holder comprises a rod holder with an insert ring inserted in a bearing container configured for holding a toilet scrubber.

4. The bathroom column hanging holder assembly according to claim 1, wherein the hanging holder comprises a magazine holder in the form of a V-shaped rod.

5. The bathroom column hanging holder assembly according to claim 1, further comprising a side tube extending outwardly from the at least one sleeve, wherein the single hanging holder is connected to the side tube.

* * * * *